United States Patent [19]

Larre et al.

[11] 4,296,946

[45] Oct. 27, 1981

[54] BOOK SUPPORT

[76] Inventors: Frank J. Larre; Jeannine G. Larre, both of Box 452, St. Walburg, Saskatchewan, Canada

[21] Appl. No.: 69,719

[22] Filed: Aug. 27, 1979

[51] Int. Cl.[3] ..... B42D 9/00

[52] U.S. Cl. ..... 281/45; 248/451; 248/465; 281/33

[58] Field of Search ..... 248/152, 331, 364, 444, 248/445, 451, 453, 454, 456, 465, 459, 463; 281/33, 45, 46, 47, 48, 49, 50

[56] References Cited

U.S. PATENT DOCUMENTS

| | | | |
|---|---|---|---|
| 647,517 | 4/1900 | Pike | 248/453 |
| 1,116,016 | 11/1914 | Cochran | 248/465 |
| 1,249,256 | 12/1917 | Vannatta | 281/33 |
| 2,478,849 | 8/1949 | Thompson, Sr. | 248/444 |
| 2,807,908 | 10/1957 | Lykes | 248/451 |
| 3,061,969 | 11/1962 | Lunday | 248/451 X |
| 3,747,889 | 7/1973 | Gerald | 248/451 |
| 3,813,075 | 5/1974 | Capper | 248/451 X |
| 3,981,522 | 9/1976 | Bloom | 248/465 X |

*Primary Examiner*—Paul A. Bell
*Attorney, Agent, or Firm*—Stanley G. Ade

[57] ABSTRACT

A book support consists of a book supporting plate and a back plate hinged to the top of the front plate and extending outwardly and downwardly when extended, to form an inverted V when viewed in side elevation. A cord is secured by each end thereof to the sides of the front plate and extend through guide apertures at the sides of the back plate to be hooked over one of several projections on the back plate to adjust the angle between the plates. A pair of slide members extend one from each side of the front plate to adjust to the width of the book and a further cord is detachably secured by one end thereof to one of said slides, passes across the open book and detachably hooks onto the other of said slides to hold the pages relatively flat. This cord is disengaged from the other slide when a page is to be turned and rehooked afterwards to hold the pages open and relatively flat. The holder can be folded relatively flat for storage, without removing the book from the holder.

10 Claims, 8 Drawing Figures

BOOK SUPPORT

BACKGROUND OF THE INVENTION

This invention relates to new and useful improvements in book holders, and although it is designed specifically for use for paperback books, nevertheless it can readily be adapted for use with hard covered books if so desired.

The prior art consists of several devices designed to hold books or manuscripts in the open position and examples of prior U.S. Patents include the following: Nos. 3,747,889-2,792,668 2,224,530-647,517-3,097,4-44-1,116,016-1,923,351 2,807,908-634,922-3,951,3-74-889,863-4,116,414 and 3,447,770.

These generally suffer from several disadvantages such as difficulty in adjusting the angle that the book is held, difficulty in holding the book in the open position with the pages relatively flat yet at the same time permitting easy turning of the pages, lack of stability and less intricate and involved structure is used and general cost of manufacture to mention just a few.

SUMMARY OF THE INVENTION

The present invention overcomes these disadvantages and in accordance with the invention there is provided a book holer and support comprising in combination a front book supporting panel and a rear panel hingedly secured by the upper edge thereof to the upper edge of said front panel to form, when open, an inverted V-shape when viewed in side elevation, means cooperating between said panels to adjust the angularity between same and within limits, and means to detachably retain a book in the open position upon said front panel.

Another aspect of the invention is to provide a device of the character herewithin described which may include means to adjust the effective width of the book support in order to accommodate same for use with different sized books.

Another advantage of the present invention is to provide a device of the character herewithin described in which the angularity of the front support panel can be varied within limits yet at the same time the adjustble means locks the panel firmly in the desired position so that good stability is assured.

A still further advantage of the invention is to provide a device of the character herewithin described in which the pages can be held in the open position yet at the same time the pages can be readily turned and reheld in the open position as desired.

Still another advantage of the invention is to provide a device of the character herewith described in which the holder can be folded relatively flat with the book still in place and in the open position.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
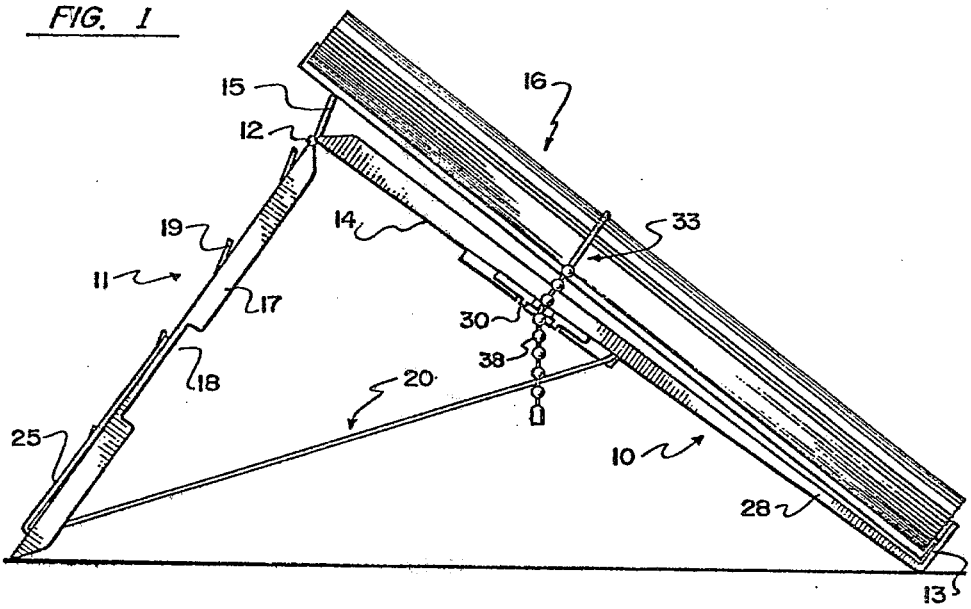
FIG. 1 is a side elevation of the device showing a book in the open position thereon.

Proceeding therefore to describe the invention in detail, a front panel collectively designated 10 is provided together with a rear panel collectively designated 11. These panels are preferably formed from synthetic plastic and are hinged by the upper edges thereof, transversely, as indicated by reference character 12. This hinge can be a conventional hinge but preferably it is what is known as a "living" hinge formed by the plastic itself and relying upon the flexible characteristic of the plastic to operate in such a manner.

An upturned lower edge 13 is provided along the lower edge of the front panel 10 and side flanges 14 are provided for stiffening purposes.

Preferably an upstanding transverse flange 15 extends across the front panel adjacent the upper edge thereof to support the back of a book shown schematically by reference character 16, said support holding the back clear of the inner surface of the back panel and facilitating the engagement of a paperback book for example, without undue instability.

The rear panel 11 includes side flanges 17 for stiffening purposes having cutout portions 18, the purpose of which will hereinafter become apparent.

Figure 3:
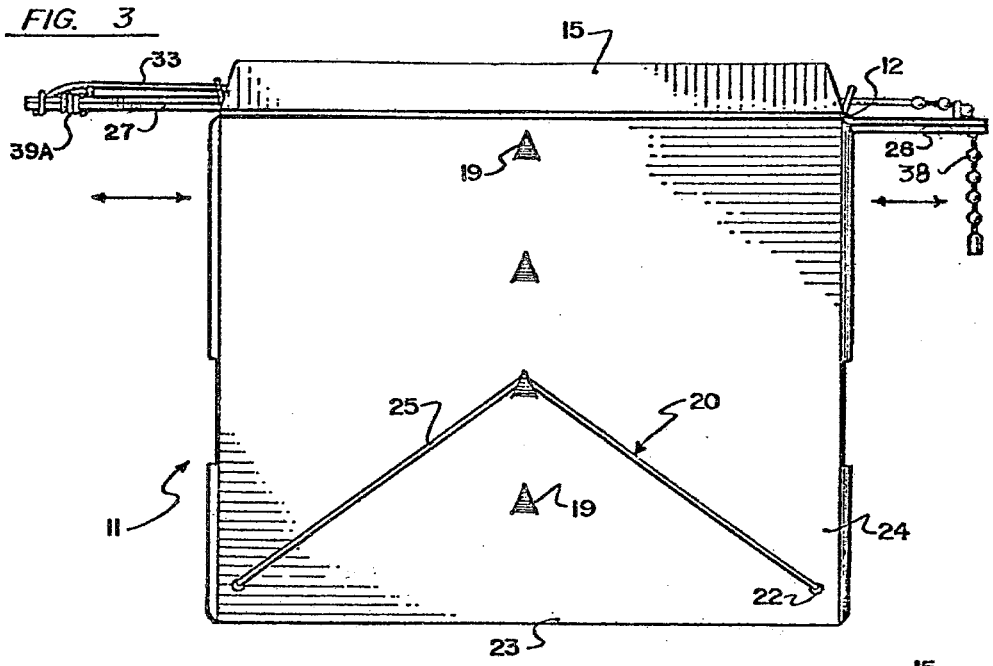
FIG. 3 is a rear elevation of the device.
Figure 5:
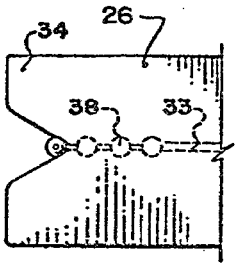
FIG. 5 is a fragmentary front elevation of the distal end of one of the slides enlarged in scale with the remainder of the drawings.
Figure 6:
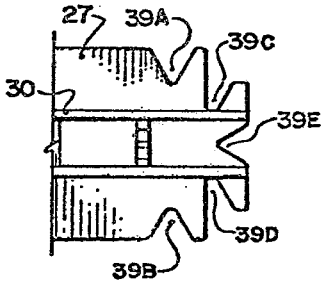
FIG. 6 is a view similar to FIG. 5 but showing the distal end of the other of said slides.

A plurality of substantially triangular pads 19 are struck out from the back panel along a vertical center line thereof to provide outwardly and upwardly inclined wedging means for a support cord collectively designated 20. This cord is anchored by the ends thereof as indicated by reference character 21, through apertures formed in the front panel adjacent the side edges thereof and spaced upwardly from the lower flange 13. The cord then passes freely through apertures 22 formed in the back panel adjacent the lower edge 23 thereof and spaced slightly inwardly from the side edges 24 thereof. The looped portion 25 of the cord then engages over any one of the projecting portions 19 as clearly shown in FIG. 3.

The engagement of this fixed length of cord over one of the projecting portions 19 adjusts the angularity of the front and rear panels and hence the angle at which the book 16 is supported.

An important aspect of this cord is the wedging effect of the projecting portions 19 when the looped portion 25 of the cord is engaged thereover. If these portions 19 were not in effect, wedges, then the looped portion 25 of the cord could slide so that side pressure on either end of the book holder, particularly towards the hinge 12, would cause instability as the rear panel could deflect with the cord sliding through the portion 19. However with the cord in effect locked in position once it has been engaged over the projection 19, the cord cannot slide thus giving excellent stability to the structure when in the errected position illustrated in FIGS. 1, 2 and 3.

Means are provided to adjust the effectve width of the front panels so that it can support books of varying widths, said means taking the form of a pair of sliding elements 26 and 27. In this embodiment, element 26 is slidably engaged relative to the rear surface 28 of the front panel and element 27 is slidably engaged relative to the front surface 29.

Figure 8:
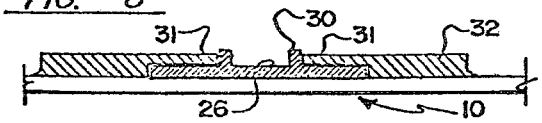
FIG. 8 is an enlarged fragmentary cross sectional view showing one method of mounting the slides for endwise movement.

Both elements 26 and 27 are mounted for transverse sliding movement relative to the front panel, by similar means shown in detail in FIG. 8.

The sliding elements are elongated strips having a pair of spaced and parallel upstanding flanges 30 formed thereon engaging the edges 31 of a pair of spaced and parallel undercut members 32 secured to the surface of the panel upon which the sliding element engages. However it will be appreciated that other methods of mounting the elements for sliding movement may be provided.

Figure 2:
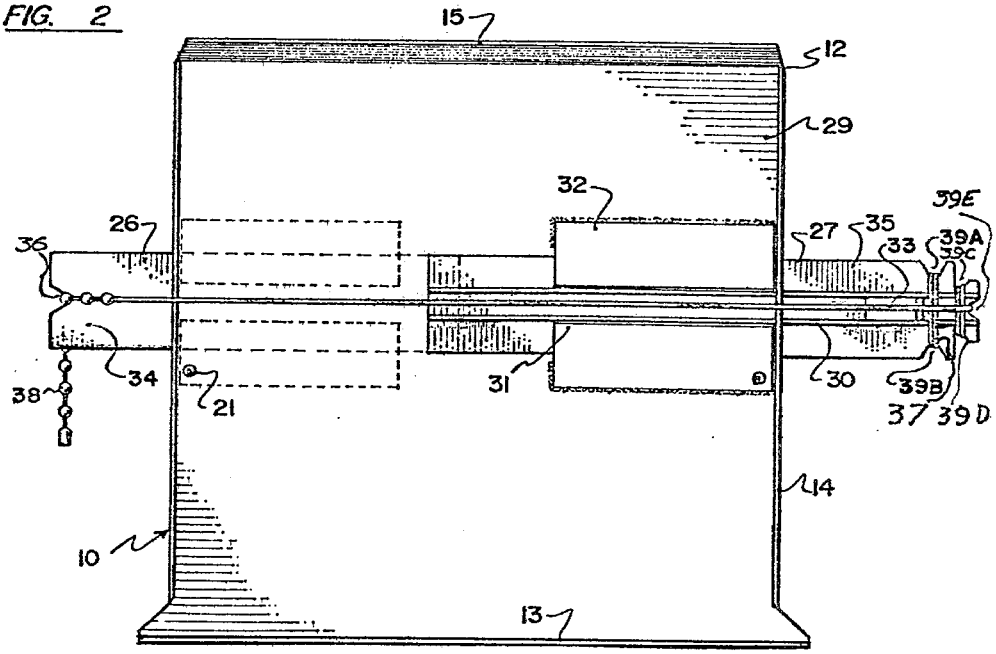
FIG. 2 is a front elevation of the device with the book removed for clarity.

Means are provided to detachably hold the book 16 in the open position illustrated in FIG. 1, said means taking the form of a further preferably transparent flexible cord collectively designated 33. This is adjustably anchored by one end thereof to the distal end 35 of the slide member 27 and detachably engageable by the other end thereof adjacent the distal end 34 of the other slide member 26.

The end 35 is notched at the upper and lower sides as at 39A and 39B and further notches 30C and 39D are provided on the end of the slide member with a central open notch 39E being formed as shown, between notches 39C and 39D. This enables the flexible cord end portion 37 to be wound around the slide member utilizing notches 39A and 39B as a large spool and notches 39C and 39D as a small spool giving finer adjustment to the length of the flexible cord. This cord then passes through notch 39E and across the open pages of the book 16 in a transverse direction and is detachably locked in the distal end 34 of the other slide member 26.

The preferred method of this detachable locking is provided by a short length of bead chain 38 similar to that used in lamp pulls and the like, secured by one end thereof to the distal end of the cord 33 and one link of this bead chain engages notch 36 formed in the distal end 34 of the other slide member 26.

This enables the desired tension to be obtained in the transversely extending portion of the cord 33 and fine adjustment can be provided by engaging the desired link of the chain in notch 36.

In operation, the holder is unfolded and the looped portion 25 of the cord 20 is engaged within the desired wedging projection 19 so that the inclination of the front panel 10 is as desired.

A book 16 is then opened and placed upon the front panel whereupon cord 33 is adjusted as to length by winding same around the distal end 35 of the slide element 27.

The flexible cord is then passed transversely across the opened pages of the book 16 with the desired link of the bead chain 38 engaging the notch 36 thus holding the book firmly in position.

In order to turn the page, it is merely necessary to disengage the bead chain 38 from the notch, lift the cord clear of the book, turn the page and reengage the desired link of the bead chain 38 within the notch 36.

Figure 4:
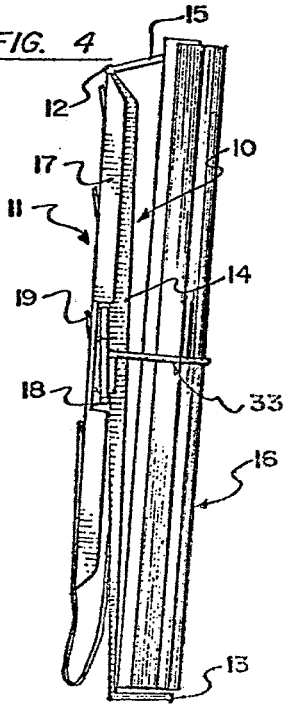
FIG. 4 is an end view of the device showing same in the folded position with a book thereon.
Figure 7:
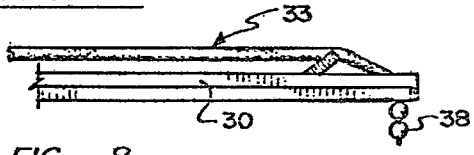
FIG. 7 is a side elevation of FIG. 5.

If it is desired to install the holder temporarily with the book in the open position, it can be folded to the position shown in FIG. 4 in which the cutout portion 18 of the side flanges 17 engage around the projecting ends of the slide portions 26 and 27. The cord may, if desired, be extended around the entire assembly and locked in position to hold same in the position shown in FIG. 4.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention:

1. A book holder and support comprising in combination a front book supporting panel and a rear panel hingedly secured by the upper edge thereof to the upper edge of said front panel to form, when open, an inverted V-shape when viewed in side elevation, means cooperating between said panels to adjust the angularity between same and within limits, and means to detachably retain a book in the open position upon said front panel, said means to adjust the angularity between said front and rear panels including a flexible cord anchored by each end thereof adjacent each side of said front panel, guide means adjacent the side edges of said rear panel, said cord passing freely through said guide means, and a plurality of vertically situated cord anchoring means extending outwardly from the rear surface of said rear panel, the looped center portion of said cord detachably engaging one of said anchoring means in non-sliding relationship.

2. The device according to claim 1 which includes means cooperating with said front panel to adjust the effective width thereof.

3. The device according to claim 2 in which said means to adjust the angularity between said front and rear panels includes a flexible cord anchored by each end thereof to adjacent each side of one of said panels, guide means adjacent the side edges of the other of said panels, said cord passing freely through said guide means, and a plurality of cord anchoring means extending from the face of the other of said panels, the looped center portion of said cord detachably engaging one of said anchoring means in non-sliding relationship.

4. The device according to claim 1 which includes means to adjust the effective width of the front panel, said last mentioned means including a pair of transversely extending elements one upon each side of said front panel and means to mount said elements upon said front panel for transverse sliding movement relative to said front panel.

5. The device according to claim 2 in which said means to adjust the effective width of said front panel includes a pair of transversely extending elements one upon each side of said front panel and means to mount said elements upon said front panel for transverse sliding movement relative to said front panel.

6. The device according to claim 3 in which said means to adjust the effective width of said front panel includes a pair of transversely extending elements one upon each side of said front panel and means to mount said elements upon said front panel for transverse sliding movement relative to said front panel.

7. The device according to claim 4 in which said means to detachably retain a book in the open position upon said front panel includes a transparent flexible cord detachably secured by one end thereof to adjacent the distal end of one of said elements and detachably and adjustably secured to adjacent the distal end of the other of said elements, said cord extending transversely across a book supported on said front panel.

8. The device according to claim 5 in which said means to detachably retain a book in the open position upon said front panel includes a transparent flexible cord detachably secured by one end thereof to adjacent the distal end of one of said elements and detachably and adjustably secured to adjacent the distal end of the other of said elements, said cord extending transversely across a book supported on said front panel.

9. The device according to claim 6 in which said means to detachably retain a book in the open position upon said front panel includes a transparent flexible cord detachably secured by one end thereof to adjacent the distal end of one of said elements and detachably and adjustably secured to adjacent the distal end of the other of said elements, said cord extending transversely across a book supported on said front panel.

10. The device according to claims 7, 8 or 9 which includes means to detachably and adjustably secure said cord by one end thereof, said means including a plurality of notches formed on said one end, said cord being wound around said one end and around said notches and means to detachably and adjustably secure the other end of said cord to the distal end of the other of said elements, said last mentioned means including a length of beaded chain secured to said other end of said cord and a notch formed in the distal end of the other of said elements, any one of said links of said beaded chain engaging said notch and detachably locking same therein.

* * * * *